US007106176B2

(12) United States Patent
La et al.

(10) Patent No.: US 7,106,176 B2
(45) Date of Patent: Sep. 12, 2006

(54) PORTABLE DEVICE-INTEROPERABLE HOME NETWORK SYSTEM

(75) Inventors: In Hwan La, Kyungki-do (KR); Oh Sung Kwon, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 139 days.

(21) Appl. No.: 10/752,489

(22) Filed: Jan. 8, 2004

(65) Prior Publication Data

US 2004/0145468 A1 Jul. 29, 2004

(30) Foreign Application Priority Data

Jan. 15, 2003 (KR) ..... 10-2003-0002655

(51) Int. Cl.
*G08B 9/00* (2006.01)

(52) U.S. Cl. ..... 340/286.01; 340/286.02; 340/286.06

(58) Field of Classification Search ..... 340/286.01, 340/286.02, 286.04, 286.05, 286.06, 509, 340/506; 713/300, 340; 707/100, 102; 702/150, 702/189; 455/41.2
See application file for complete search history.

(56) References Cited

U.S. PATENT DOCUMENTS 6,748,340 B1 * 6/2004 Otsuki et al. ..... 702/150
6,907,225 B1 * 6/2005 Wilkinson ..... 455/41.2
6,917,902 B1 * 7/2005 Alexander ..... 702/189
6,934,862 B1 * 8/2005 Sharood et al. ..... 713/300
6,947,943 B1 * 9/2005 DeAnna et al. ..... 707/100
2003/0018776 A1 1/2003 Yoon et al.

FOREIGN PATENT DOCUMENTS

WO 01/63389 8/2001

* cited by examiner

*Primary Examiner*—Van T. Trieu
(74) *Attorney, Agent, or Firm*—Greenblum & Bernstein, P.L.C.

(57) ABSTRACT

A portable device-interoperable home network system includes a home server controls data transmission and reception of an internal network to which a plurality of home appliances are connected in a home. An image server outputs information regarding at least one image in the home to the home server. A portable device server receives the image information from the image server via the home server and transfers it to a portable electronic device. Therefore, a user can recognize a situation in the home through the portable electronic device from anywhere outside of the home, resulting in an increase in convenience of use.

20 Claims, 5 Drawing Sheets

PORTABLE DEVICE-INTEROPERABLE HOME NETWORK SYSTEM

BACKGROUND OF THE INVENTION

1. Field of the Invention

The present invention relates to home network systems interoperable with portable electronic devices, and more particularly to a portable device-interoperable home network system wherein a home server is provided to control a plurality of home appliances in a home, and a portable device server is connected with the home server to transfer home appliance control information and so forth from the home server to a user's portable electronic device.

2. Description of the Related Art

In home network systems, generally, a plurality of home appliances installed in each home are equipped with network interfaces, respectively, so that they can be networked so as to be controllable over an internal network.

In particular, recently, with the significant increase in the use of the Internet and the reduction in users' time spent at homes, the demand for home network systems in which the users can control home appliances in their homes over the Internet from anywhere outside of the homes has rapidly increased.

FIG. 1 shows the configuration of one such conventional home network system.

As shown in FIG. 1, the conventional home network system comprises a plurality of network interfaces 1 installed respectively in a plurality of home appliances in a home to transmit and receive data, and a home server 2 for controlling transmission and reception of data on an internal network through the network interfaces 1. The home server 2 is also adapted to transmit and receive data to/from an external Internet network.

By means of this configuration, a home appliance user is able to access the home server 2 through a personal computer (PC) on the external Internet network from a place outside of the home and then control the home appliances in the home.

However, the above-mentioned conventional home network system has a disadvantage in that the home appliance user who uses an external PC or etc. cannot recognize a situation occurring in the home from the outside of the home, so he/she cannot recognize a fire or gas leak if one occurs in the home.

SUMMARY OF THE INVENTION

Therefore, the present invention has been made in view of the above problems, and it is an object of the present invention to provide a portable device-interoperable home network system wherein a portable device server is connected with an image server via a home server to transfer an image in a home to an electronic device carried by a user, thereby reducing the user's anxiety about the intrusion of a burglar or the occurrence of a fire in the home.

In accordance with the present invention, the above and other objects can be accomplished by the provision of a home network system interoperable with a portable electronic device, comprising: a home server for controlling data transmission and reception of an internal network to which a plurality of home appliances are connected in a home; an image server for outputting information regarding at least one image in the home to the home server; and a portable device server for receiving the image information from the image server via the home server and transferring it to the portable electronic device.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
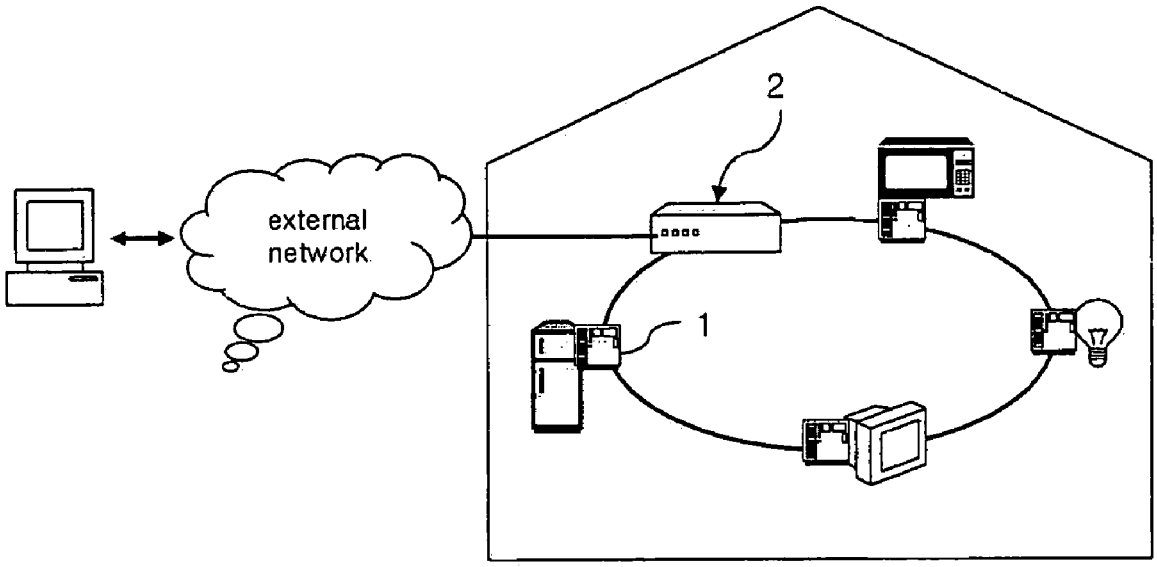
FIG. 1 (Prior Art)
FIG. 1 is a view showing the configuration of a conventional home network system.
Figure 2:
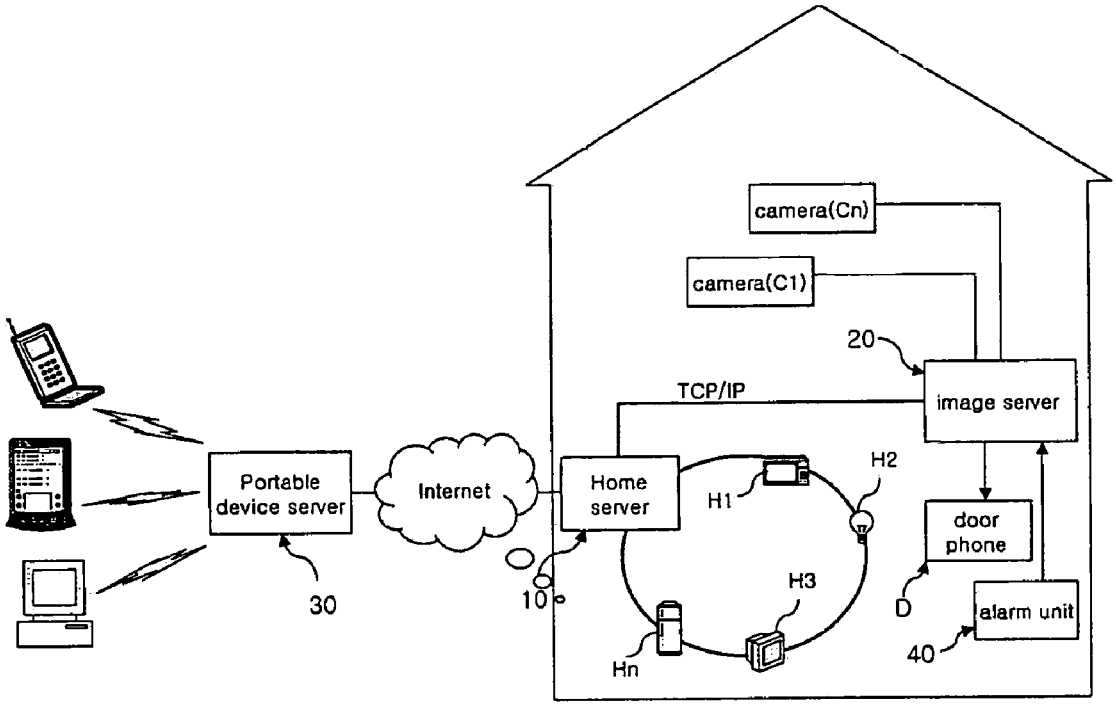
FIG. 2 is a block diagram showing the configuration of a portable device-interoperable home network system according to a first embodiment of the present invention.

With reference to FIG. 2, there is shown in block form the configuration of a portable device-interoperable home network system according to a first embodiment of the present invention. As shown in this drawing, the home network system comprises a home server 10 for controlling data transmission and reception of a plurality of home appliances H1–Hn connected to an internal network I and sending a control command inputted by a user to a corresponding one of the home appliances H1–Hn, an image server 20 for acquiring information regarding images in a home through a plurality of cameras C1–Cn installed in the home and sending the acquired image information to the home server 10 over a transmission control protocol/Internet protocol (TCP/IP) network, and a portable device server 30 for transmitting and receiving data to/from the home server 10 over an external Internet network constructed outside of the home, receiving the image information from the image server 20 via the home server 10 and transferring it to a portable electronic device carried by the user, such as a mobile phone, personal digital assistant (PDA) or notebook computer.

The portable device-interoperable home network system according to the first embodiment of the present invention further comprises a display unit, such as a door phone D, connected with the image server 20 for displaying the image information from the image server 20 so that it can be recognized by the user, and an alarm unit 40 for sensing intrusion of a burglar into the home. The alarm unit 40 includes a sensor installed in an entrance of the home.

Figure 3:
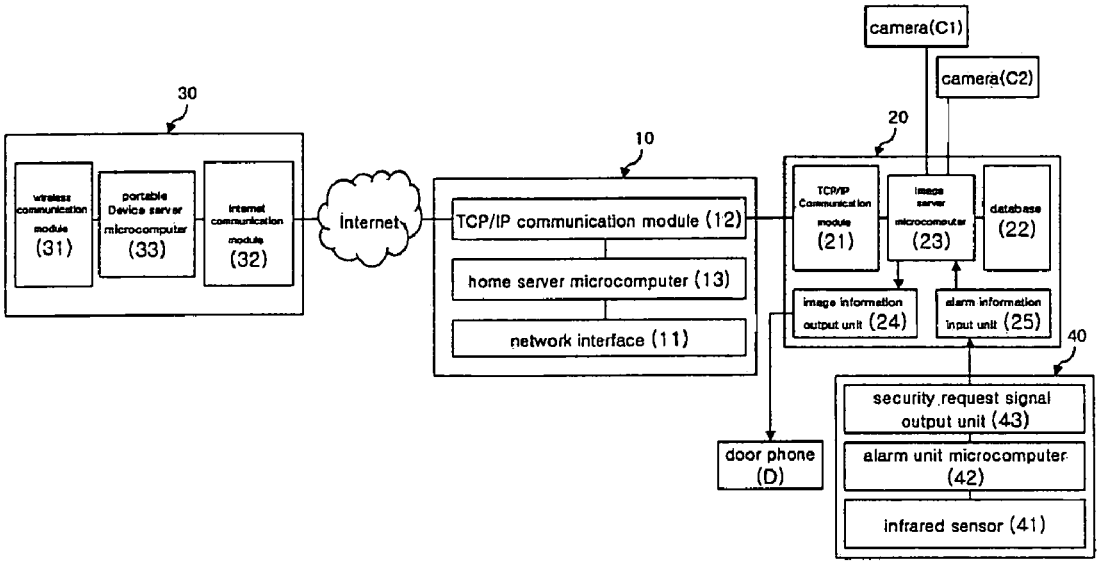
FIG. 3 is a detailed block diagram of the home network system of FIG. 2.

The portable device server 30 includes, as shown in FIG. 3, a wireless communication module 31 for transferring data to the portable electronic device such as the mobile phone, PDA or notebook computer, an Internet communication module 32 for transmitting and receiving data to/from the home server 10 over the external Internet network, and a portable device server microcomputer 33 for controlling the data transmission and reception of the wireless communication module 31 and Internet communication module 32, receiving the image information from the image server 20 via the home server 10 and Internet communication module 32 and transferring it to the portable electronic device.

The home server 10 includes, as shown in FIG. 3, a network interface 11 for transmitting and receiving data to/from the internal network over which the home appliances H1–Hn transmit and receive data, a TCP/IP communication module 12 for transmitting and receiving data to/from the portable device server 30 and the image server 20, respectively, over the external Internet network and the TCP/IP network, and a home server microcomputer 13 for controlling the data transmission and reception of the network interface 11 and TCP/IP communication module 12 and sending the image information from the image server 20 to the portable device server 30 through the TCP/IP communication module 12 and, as needed, to the internal network through the network interface 11 so that the image information can be displayed in the home appliances H1-Hn.

The cameras C1–Cn are installed in the home to capture images in the home. The image server 20 includes, as shown in FIG. 3, an image server microcomputer 23 for processing images captured by the cameras C1–Cn to generate image information and outputting the generated image information to the home server 10 or door phone D, a TCP/IP communication module 21 for transmitting and receiving data to/from the home server 10 and outputting the generated image information to the home server 10, under the control of the image server microcomputer 23, an image information output unit 24 for outputting the generated image information to the door phone D under the control of the image server microcomputer 23, and an alarm information input unit 25 for receiving alarm information from the alarm unit 40 and delivering it to the image server microcomputer 23. The image server 20 further includes a database 22 for storing the image information acquired through the cameras C1–Cn.

In particular, where the alarm information input unit 25 receives the alarm information from the alarm unit 40, the image server microcomputer 23 outputs image information contained in the alarm information or image information acquired through the cameras C1–Cn at that time to the home server 10, so that image information acquired upon intrusion of a burglar into the home can be transferred to the portable electronic device.

The alarm unit 40 includes, as shown in FIG. 3, at least one infrared sensor 41 installed in the entrance of the home for sensing intrusion of a burglar into the home, an alarm unit microcomputer 42 for determining whether the infrared sensor 41 has sensed intrusion of a burglar into the home and generating a security request signal upon determining that the infrared sensor 41 has sensed the burglar intrusion, and a security request signal output unit 43 for sending the generated security request signal to an external security service provider server or the image server.20.

Figure 4:
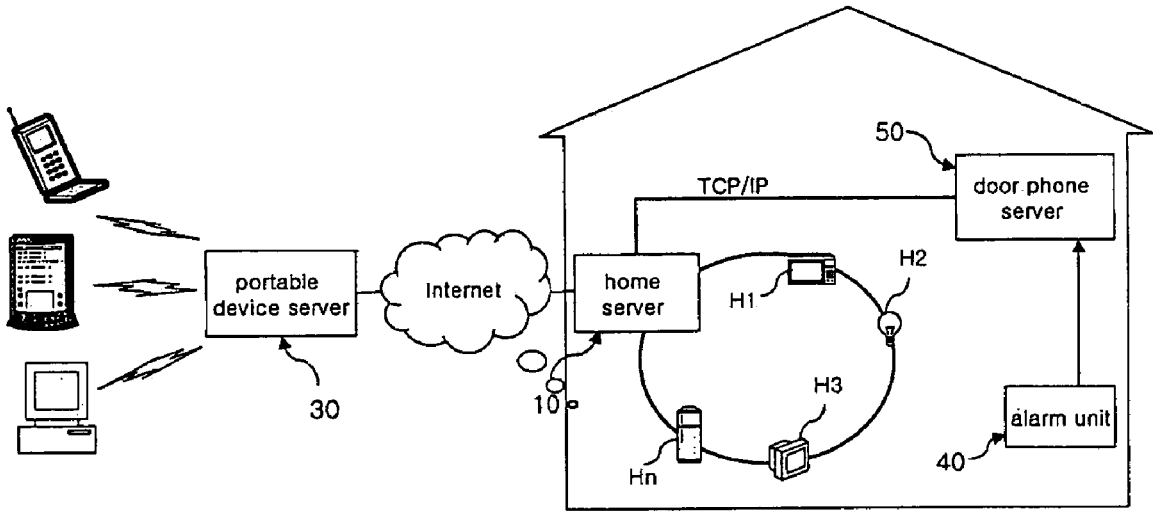
FIG. 4 is a block diagram showing the configuration of a portable device-interoperable home network system according to a second embodiment of the present invention.

With reference to FIG. 4, there is shown in block form the configuration of a portable device-interoperable home network system according to a second embodiment of the present invention.

In the second embodiment, the portable device-interoperable home network system comprises a portable device server 30, a home server 10 and a door phone server 50. That is, the second embodiment is substantially the same in construction as the first embodiment, with the exception that the door phone server 50 is provided instead of the image server. This second embodiment is based on the fact that the intrusion of a burglar into the home can be sensed through the use of an existing door phone usually installed in the home, without separately installing a plurality of cameras in the home as in the first embodiment.

Therefore, the user can check the security state in the home or office through an external portable device by constructing the door phone server 50 including the door phone and enabling the door phone server 50 to transmit and receive data to/from the home server 10.

Figure 5:
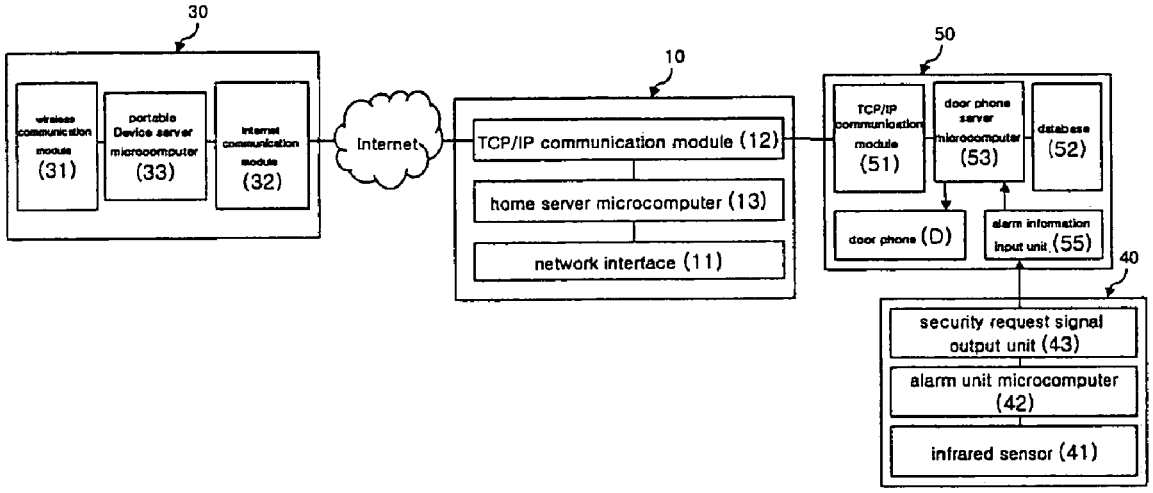
FIG. 5 is a detailed block diagram of the home network system of FIG. 4.

FIG. 5 is a detailed block diagram of the home network system of FIG. 4.

As shown in FIG. 5, the door phone server 50 includes a TCP/IP communication module 51 for transmitting and receiving data to/from the home server 10 according to a TCP/IP communication protocol, and a door phone server microcomputer 53 for storing image information received from the door phone D in a database 52 and controlling the data transmission and reception of the TCP/IP communication module 51.

The home network system according to the second embodiment further comprises an alarm unit 40 in a similar manner to that of the first embodiment. In this connection, the door phone server 50 further includes an alarm information input unit 55 connected to the door phone server microcomputer 53 for inputting an alarm signal sent from the alarm unit 40 to the microcomputer 53.

Therefore, the user can check the state of the door phone D through the door phone server 50 linked with the door phone D from a place outside of the home without separately installing cameras in the home, so he/she can check the security state in the home or office even when being present at another location.

As apparent from the above description, the present invention provides a portable device-interoperable home network system wherein a home server is provided to control data transmission and reception of an internal network to which a plurality of home appliances are connected in a home, an image server is provided to output information regarding at least one image in the home to the home server, and a portable device server is provided to receive the image information from the image server via the home server and transfer it to a portable electronic device. Therefore, a user can recognize a situation in the home through the portable electronic device from anywhere outside of the home, resulting in an increase in convenience of use.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A home network system interoperable with a portable electronic device, comprising:

a home server that controls data transmission and reception of an internal network to which a plurality of home appliances are connected in a home;

an image server that outputs image information regarding at least one image in the home to said home server; and a portable device server, connected to said home server via the Internet, that receives said image information from said image server via said home server and the Internet and transfers the image information to said portable electronic device.

2. The home network system according to claim 1, further comprising at least one camera that captures said at least one image in the home and sends it to said image server.

3. The home network system according to claim 2, wherein said image server includes:

a transmission control protocol/Internet protocol (TCP/IP) communication module that sends said image information to said home server according to a TCP/IP communication protocol;

a database that stores said image information; and an image server microcomputer that controls data transmission and reception of said TCP/IP communication module and the storage of said information regarding said image captured by said at least one camera in said database.

4. The home network system according to claim 2, further comprising a display that displays said information regarding said image sent from said at least one camera to said image server.

5. The home network system according to claim 4, wherein said image server further includes an image information output unit that outputs said image information to said display.

6. The home network system as set forth in claim 2, further comprising an alarm that senses an intrusion into the home, wherein said alarm sends a sensed result to said image server upon sensing the intrusion.

7. The home network system according to claim 6, wherein said alarm includes:

at least one sensor that senses an intrusion into the home;

an alarm microcomputer that determines whether said sensor has sensed an intrusion into the home and generates a security request signal upon determining that said sensor has sensed the intrusion; and a security request signal output unit connected to an external security service provider server that sends said security request signal thereto.

8. The home network system according to claim 6, wherein said image server further includes an alarm information input unit that receives the sensed result sent from said alarm.

9. The home network system according to claim 6, wherein the alarm is installed in an entrance of the home.

10. The home network system according to claim 1, wherein said home server includes:

a network interface that transmits and receives data to and from said internal network;

a TCP/IP communication module that transmits and receives data to and from said portable device server and said image server, respectively, over the Internet and a TCP/IP network; and a home server microcomputer that controls the data transmission and reception of said network interface and TCP/IP communication module and sends said image information from said image server to said home appliances connected to said internal network.

11. The home network system according to claim 1, wherein said image server includes a door phone server that acquires image information through a camera contained in a door phone and sends the acquired image information to said home server to provide a security state of the home to a user.

12. The home network system as set forth in claim 11, wherein said door phone server includes:

a TCP/IP communication module that transmits and receives data to and from said home server over a TCP/IP network;

a database that stores said image information acquired through said door phone; and a door phone server microcomputer that controls the data transmission and reception of said TCP/IP communication module and the storage of said image information acquired through said door phone in said database.

13. The home network system according to claim 11, further comprising an alarm that senses an intrusion into the home, wherein said alarm sends a sensed result to said door phone server upon sensing the intrusion.

14. The home network system according to claim 13, wherein said door phone server further includes an alarm information input unit that receives the sensed result sent from said alarm.

15. A portable device server, configured to connect to a home server via the Internet, comprising:

a receiver that receives image information, regarding at least one image in a home, from a home server via the Internet, the home server controlling data transmission and reception of an internal network to which a plurality of home appliances are connected in a home; and a transmitter that transmits the image information to a portable electronic device.

16. The portable device server according to claim 15, wherein the receiver comprises an Internet communication module, and the transmitter comprises a wireless communiction module.

17. The building network system interoperable with a portable electronic device, comprising:

a building server that controls data transmission and reception of an internal network to which a plurality of building appliances are connected in a building;

an image server that outputs image information regarding at least one image in the building to said building server; and a portable device server, connected to said building server via the Internet, that receives said image information from said image server via said building server and the Internet and transfers the image information to said portable electronic device.

18. The building network system according to claim 17, further comprising at least one camera that captures said at least one image in the building and sends it to said image server.

19. The building network system according to claim 17, wherein said building server includes:

a network interface that transmits and receives data to and from said internal network;

a TCP/IP communication module that transmits and receives data to and from said portable device server and said image server, respectively, over the Internet and a TCP/IP network; and a building server microcomputer that controls the data transmission and reception of said network interface and TCP/IP communication module and sends said image information from said image server to said building appliances connected to said internal network.

20. The building network system according to claim 17, wherein said image server includes a door phone server that acquires image information through a camera contained in a door phone and sends the acquired image information to said building server to provide a security state of the building to a user.

* * * * *